US006023845A

United States Patent [19]

Moore

[11] Patent Number: 6,023,845

[45] Date of Patent: Feb. 15, 2000

[54] ELECTRIC CIGAR CUTTER

[76] Inventor: Loyd C. Moore, 35 W. 95th St., New York, N.Y. 10025

[21] Appl. No.: 09/084,540

[22] Filed: May 26, 1998

[51] Int. Cl.[7] ..... A24C 1/24

[52] U.S. Cl. ..... 30/110; 131/248

[58] Field of Search ..... 131/248, 250; 30/109, 110, 112, 113

[56] References Cited

U.S. PATENT DOCUMENTS

| | | | |
|---|---|---|---|
| 630,534 | 8/1899 | Fornander | 30/110 |
| 674,972 | 5/1901 | Lehman et al. . | |
| 678,760 | 7/1901 | Perew . | |
| 694,591 | 3/1902 | Walker | 30/110 |
| 845,536 | 2/1907 | Dick | 30/110 X |
| 1,124,590 | 1/1915 | Caspers et al. | 30/110 |
| 1,168,445 | 1/1916 | Van Dersal . | |
| 1,218,830 | 3/1917 | Bergeson | 30/110 X |
| 1,251,300 | 12/1917 | Stickle | 30/110 |
| 1,538,522 | 5/1925 | Spinner et al. | 30/109 X |
| 1,730,438 | 10/1929 | Schulz . | |
| 3,903,598 | 9/1975 | Lefebvre . | |
| 5,345,952 | 9/1994 | Nielander | 131/248 |
| 5,745,995 | 5/1998 | Yamashita et al. | 30/43.6 |
| 5,836,318 | 11/1998 | Adams | 131/253 |

*Primary Examiner*—M. Rachuba
*Assistant Examiner*—T. Anthony Vaughn
*Attorney, Agent, or Firm*—Selitto & Associates

[57] ABSTRACT

An electric cigar cutter employs a motor-driven, rotatable cutting blade which functions to trim a cigar by cutting off the tip. The cutting blade pivots, and as it pivots, it passes through the cigar, thereby cutting the tip. The present invention incorporates two safety features, to prevent accidental activation of the cigar cutter and to protect a user's fingers from contacting the cutting blade. Additionally, a mechanism is provided for adjusting the amount of the cigar to be cut off.

22 Claims, 7 Drawing Sheets

ELECTRIC CIGAR CUTTER

FIELD OF THE INVENTION

The present invention relates to cigar cutters, and, more particularly, to an electric cigar cutter employing a motor-driven cutting blade.

BACKGROUND OF THE INVENTION

Electric cigar cutters employing a motor-driven blade are known in the art. For example, in U.S. Pat. No. 1,730,438 to Schulz, once the user places a cigar into a cutter opening and activates the motor, the cutting blade travels in a circular path around the cigar, thereby cutting the tip off the cigar. In Van Dersal U.S. Pat. No. 1,168,445, the user inserts a cigar tip into an opening, depressing a button to thereby complete an electrical circuit which activates the device. A blade, which is spring-biased to apply cutting pressure, is attached to a frame which travels around the cigar in a circular path, cutting the tip of the cigar as the frame moves. Neither of these devices allows the user to adjust the length of the tip of the cigar that is cut off, always cutting off a predetermined length of the cigar tip. Additionally, both of these devices expose the user's fingers to a risk of being cut during operation.

The present invention aims to overcome these disadvantages while at the same time providing an efficient, cleanly cut cigar tip.

SUMMARY OF THE INVENTION

The present invention employs a rotating cutting blade that is moved through the tip of a cigar, as opposed to being moved around the cigar like the prior art devices described above. The present invention also incorporates several safety features and a mechanism for adjusting the length of the portion of the tip of the cigar that is cut off.

More particularly, the electric cigar cutter of the present invention has a housing, with a removable trimmings drawer adapted to hold the cut-off cigar tips. Attached to the housing is a finger guard, which prevents a user from accidentally inserting his/her finger into the cutter opening. An outer surface of the drawer has a contact, which engages a corresponding contact located inside the housing to complete an electrical circuit and thereby act as a safety switch. In other words, the present device will not operate unless the drawer is inserted and the safety circuit is completed. The inside of the drawer contains an adjustable end stop, which is used to set the length of the portion of the tip that is cut off the cigar.

In operation, the user places a cigar into a cigar holding tube, formed between the housing and the finger guard. Once the cigar is properly positioned by the end stop in the drawer, the user pulls a lever toward the cigar tube, moving a cutting blade into position to cut the tip. As the lever is being moved, two internal electrical contacts engage, starting a motor and the rotation of the cutting blade. As the cutting blade contacts the cigar, it is rotating at approximately 200 RPM, thereby cleanly cutting off the tip of the cigar, which drops into the underlying trimmings drawer.

BRIEF DESCRIPTION OF THE DRAWINGS

For a better understanding of the present invention, reference is made to the following detailed description of two exemplary embodiments considered in conjunction with the accompanying drawings, in which.

DETAILED DESCRIPTION OF THE EXEMPLARY EMBODIMENTS

Figure 1:
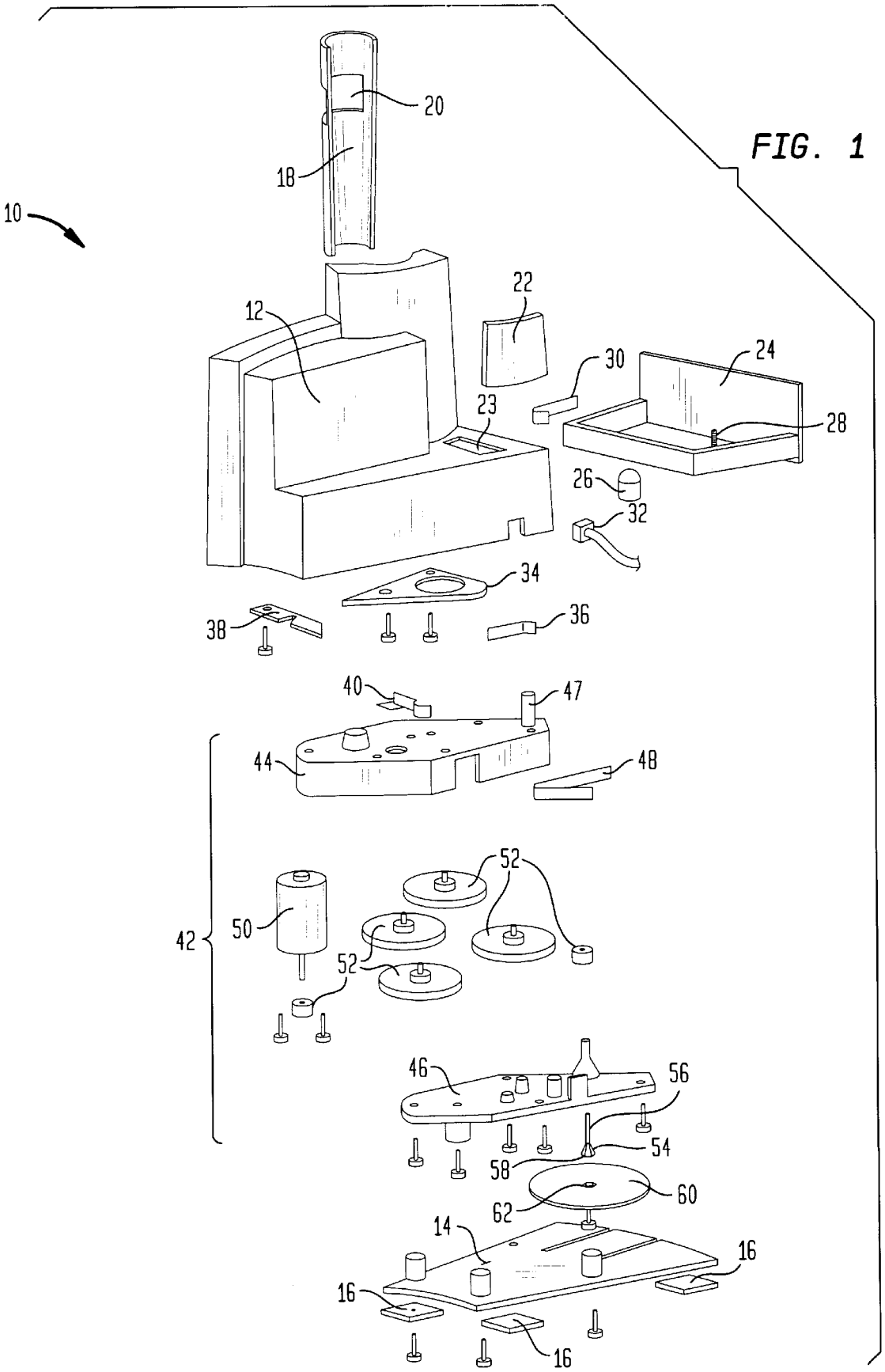
FIG. 1 is an exploded rear perspective view of an electric cigar cutter constructed in accordance with an exemplary embodiment of the present invention.

FIG. 1 shows an electric cigar cutter 10, having a housing 12 and a housing bottom 14 with rubber feet 16. A finger guard 18, with a finger access 20, is permanently mounted on the housing 12. A lever 22 is slidably positioned on the housing 12, over a slot 23 in the housing 12, and behind that portion of the housing 12 where the finger guard 18 is mounted. A removable trimmings drawer 24 is located on a side of the housing 12, near the lever 22. An adjustable end stop 26 is threadably positioned inside the drawer 24, on a fixed stop mount 28. A drawer contact 30 is attached on an exterior portion of the drawer 24.

Figure 6:
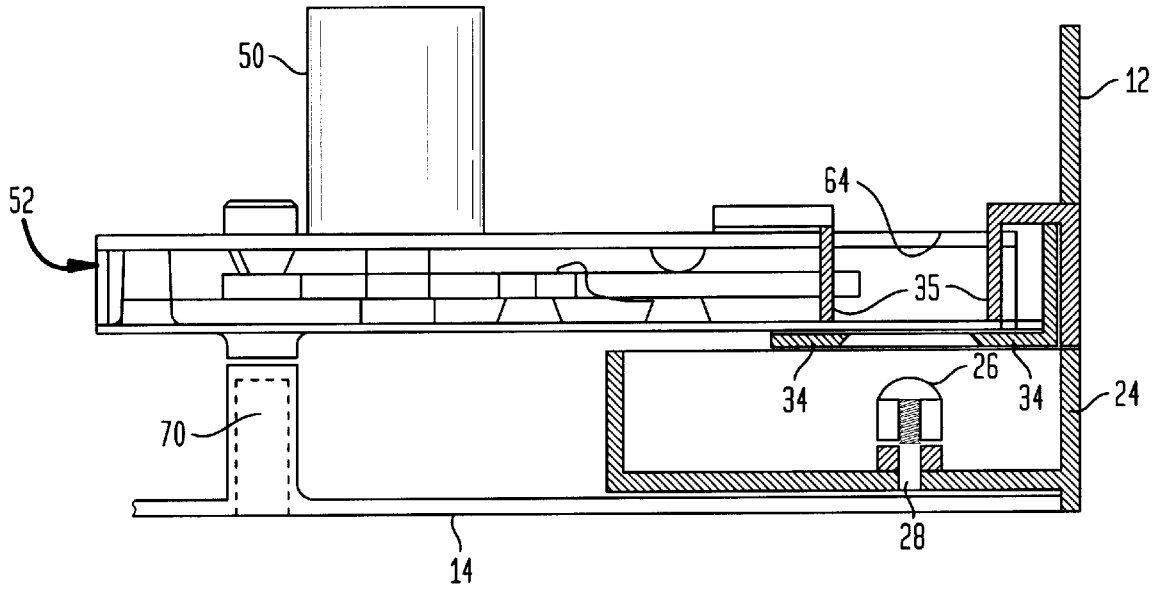
FIG. 6 is a cross-sectional side view of the cigar cutter shown in FIG. 1.

A power connector 32 for connection to a power source is located at the rear of the housing 12, on the same side of the housing 12 as the drawer 24. A cutter guard 34 is mounted inside the housing 12, above the drawer 24, and is used in cooperation with another cutter guard 35 (see FIG. 6) which is molded into the interior of the housing 12, for purposes that will be discussed below. A safety switch contact 36 is positioned inside the housing 12, such that when the drawer 24 is in place inside the housing 12, the drawer contact 30 engages the safety switch contact 36.

A housing contact 38 is positioned inside the housing 12 such that it can engage a gear box contact 40 when the cigar cutter 10 is activated, as will be described below. The gear box contact 40 is attached to a gear box 42, which consists of a gear box top 44 and a gear box bottom 46. A gear box post 47 is molded onto the gear box top 44, fitting through the slot 23 in the housing 12, where it is connected to the lever 22. A return spring 48 is positioned on the side of the gear box top 44 for a purpose to be described below. A motor 50 drives a gear train 52, the gear train 52 being located inside the gear box 42. A blade shaft 54 is connected at an upper end 56 thereof to the gear train 52. The blade shaft 54 has a hexagonally-shaped face 58, which connects the shaft 54 to a cutting blade 60 via a complementary hexagonally-shaped hub 62.

Figure 2:
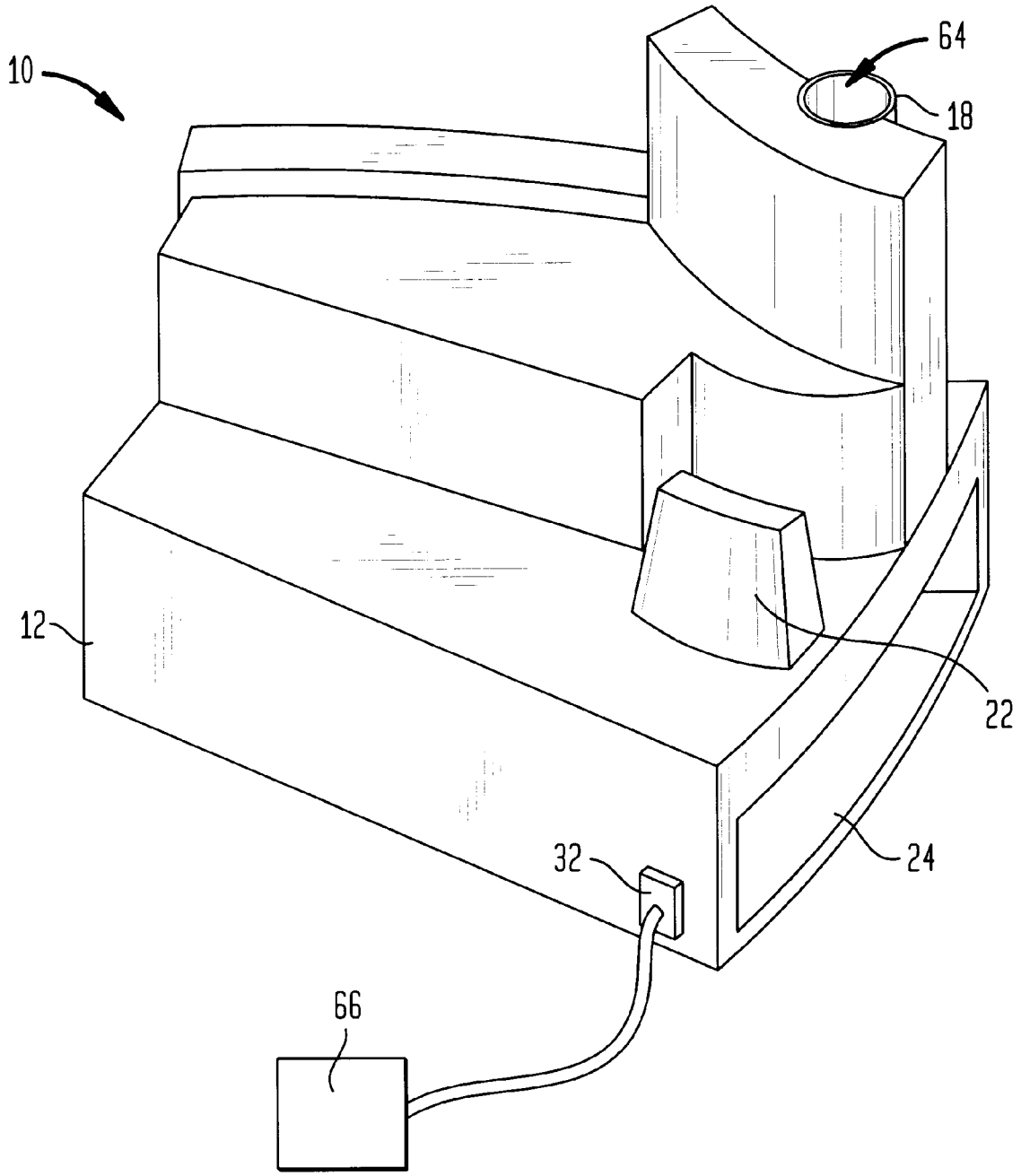
FIG. 2 is a rear perspective view of the cigar cutter shown in FIG. 1.

FIGS. 2–6 illustrate the assembled cigar cutter 10 and will be used to explain its operation. Referring now to FIG. 2, a cigar holding tube 64 is formed by the respective curvatures of the finger guard 18 and the housing 12. The cigar holding tube 64 is 3.75 inches deep and 0.875 inches in diameter, and is designed as a safety feature (meeting the Underwriters' Laboratories Test No.982), preventing the user's finger from coming into contact with the cutting blade 60. An A.C. power source 66 is connected at the power connector 32 to supply power to the cigar cutter 10.

Figure 3:
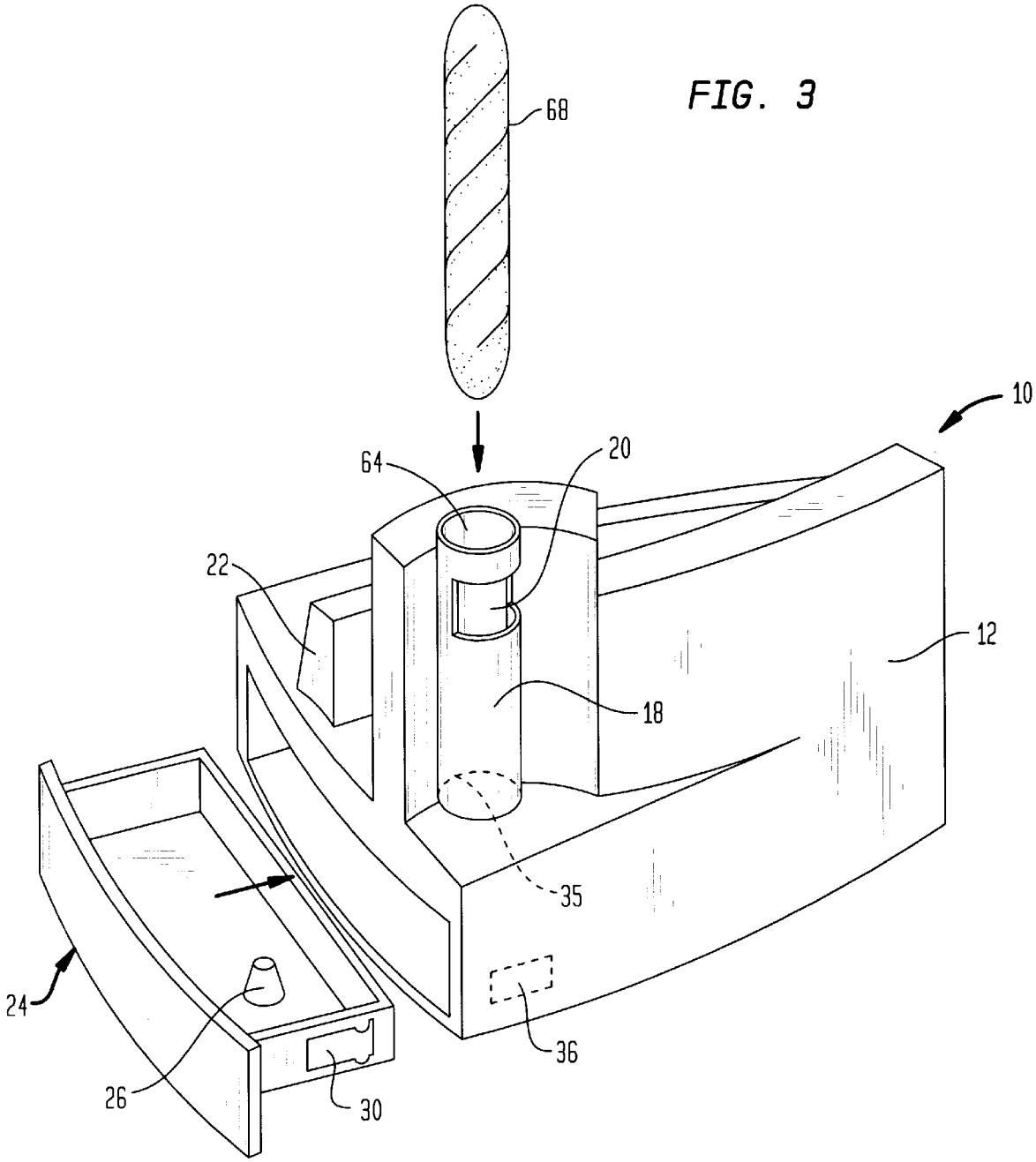
FIG. 3 is a front perspective view of the cigar cutter shown in FIG. 1, showing the trimmings drawer removed.

As shown in FIG. 3, the drawer 24 is removed from the housing 12 to reveal the adjustable end stop 26. The end stop 26 is threaded onto the stop mount 28 (see FIG. 1). To adjust the length of the portion of the tip of the cigar to be cut off, the end stop 26 is rotated, raising or lowering the position of the end stop 26 on the stop mount 28, thereby shortening or lengthening, respectively, the amount cut. The drawer 24 is then replaced in the housing 12, where the drawer contact 30 engages the safety switch contact 36. The contacts 30, 36 act in conjunction as a safety switch, allowing the cigar cutter 10 to be operational only when the drawer 24 is inserted into the housing 12. The contacts 30, 36 also cooperate to hold the drawer 24 in place inside the housing 12.

To operate the cigar cutter 10, a cigar 68 is inserted into the cigar holding tube 64, which holds the cigar 68 in an upright (i.e., vertical) position. The inserted tip of the cigar 68 will rest on the end stop 26 when the cigar 68 is in position. For added stability during cutting, the user can place a finger into the finger access 20 to hold the cigar 68 steady. The finger access 20 can also be used to steady short (less than 4 inches in length) cigars within the cigar holding tube 64, and to help remove short cigars after cutting is completed. The cutter guards 34, 35 steady the end of the cigar 68 that has been inserted into the cigar holding tube 64, the lower end of which is delimited by the cutter guard 35. The cutter guard 34 is located below the cutting blade 60, while the other cutter guard 35 is located above the cutting blade 60, thereby defining a cutting site (see FIG. 6). The cutter guards 34, 35 are positioned above and below the cutting blade 60 to support the sides of the cigar 68 during cutting, and to allow the cutting blade 60 to make a clean cut through the outer wrapper leaf of the cigar 68.

Figure 4:
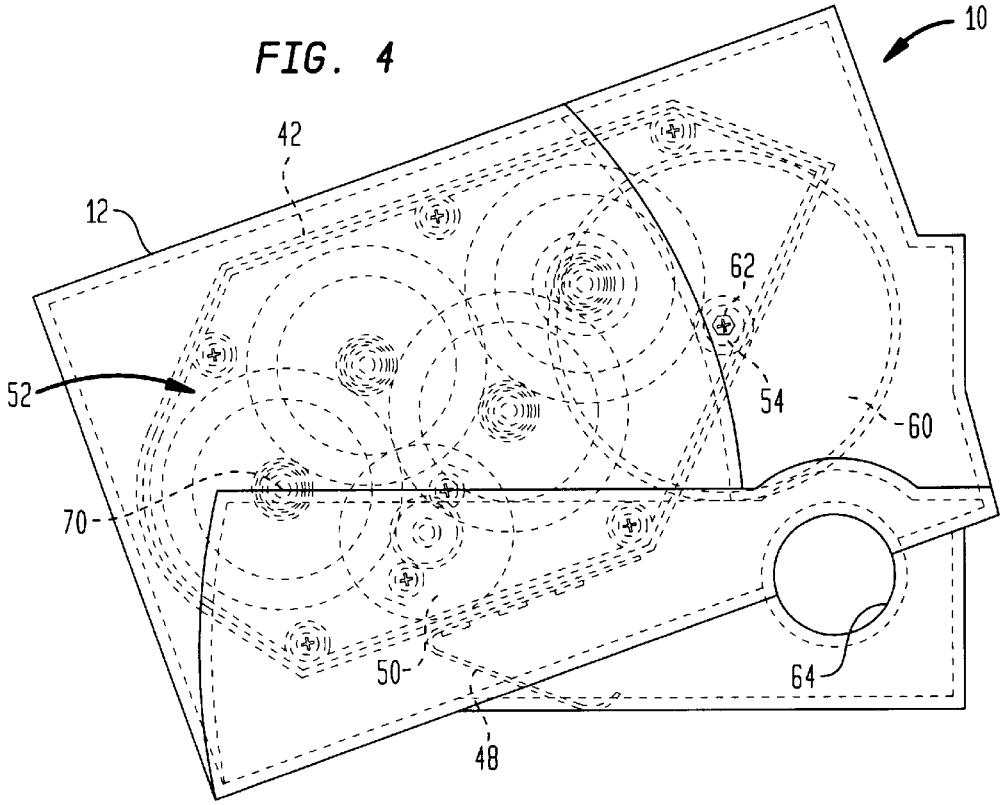
FIG. 4 is a top plan view of a gear box for the cigar cutter shown in FIG. 1, the gear box being shown in its non-operational position.
Figure 5:
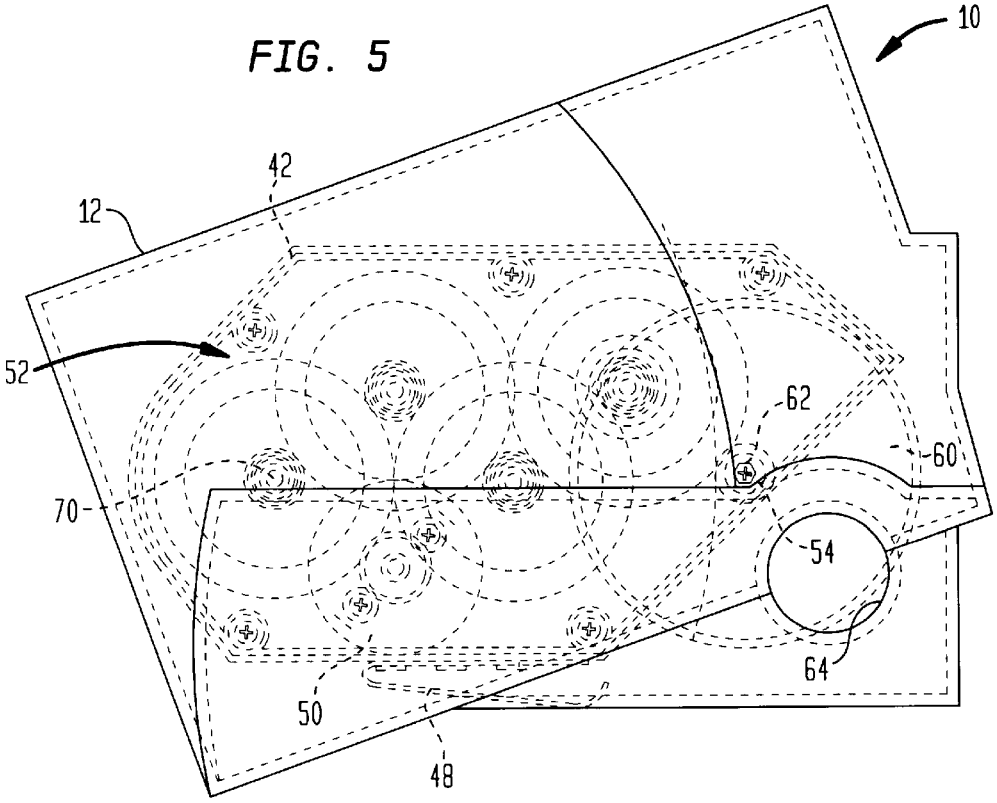
FIG. 5 is a top plan view of the gear box of FIG. 4, the gear box being shown in its operational position.

When the cigar cutter 10 is not in operation, the gear box 42 and the cutting blade 60 are in the position indicated in FIG. 4, with the blade 60 being out of contact with the cigar 68. Once the cigar 68 is in position in the cigar holding tube 64, the user pulls the lever 22 toward the cigar holding tube 64. As the lever 22 is moved, the gear box post 47 is moved, thereby rotating the gear box 42 and the cutting blade 60 about a pivot 70 (see FIG. 6). While the gear box 42 is moving, the gear box contact 40 strikes the housing contact 38, thereby completing the electric circuit and activating the motor 50. The motor 50 operates at approximately 6,300 RPM, driving the gear train 52, which steps down the rotational speed of the blade shaft 54 and the cutting blade 60 to about 200 RPM.

The cutting blade 60 is moved across the tip of the cigar 68, cutting it off with the tip falling into the underlying drawer 24. When the cigar 68 has been cut, the gear train 52 and the cutting blade 60 are in the position shown in FIG. 5, compressing the return spring 48 between the gear box 42 and the interior of the housing 12. Once the cigar has been cut, the user releases the lever 22, allowing the return spring 48 to expand and push the gear box 42 and the cutting blade 60 back into the non-operational position (see FIG. 4). As the gear box 42 and the cutting blade 60 return to the non-operational position, the gear box contact 40 breaks the connection with the housing contact 38, thereby automatically shutting off the motor 50, the gear train 52, the blade shaft 54, and hence the cutting blade 60. The cut tip of the cigar 68 is now lying in the drawer 24, which can be emptied by removing the drawer 24 from the housing 12.

Figure 7:
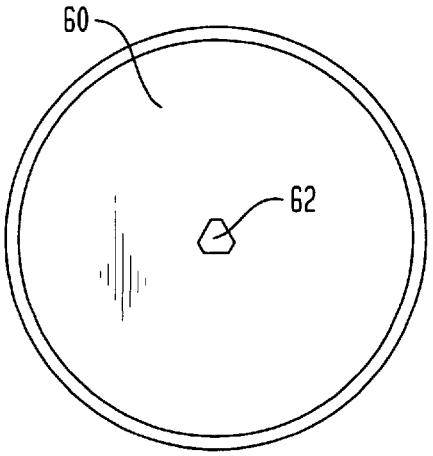
FIG. 7 is a top plan view of a cutting blade for the cigar cutter shown in FIG. 1.
Figure 8A:
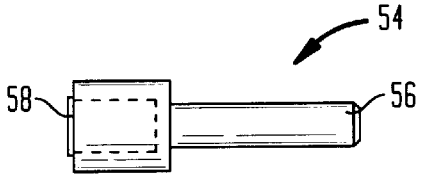
FIG. 8A is a side view of a blade shaft for the cigar cutter shown in FIG. 1.
Figure 8B:
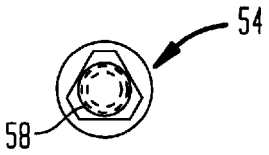
FIG. 8B is an end view of the blade shaft shown in FIG. 8A.

FIGS. 7, 8A, and 8B show details of the interface between the blade shaft 54 and the cutting blade 60. Referring now to FIG. 7, the cutting blade 60 has a hexagonally-shaped hub 62, in the shape of an equilateral triangle having blunt corners. As shown in FIGS. 8A and 8B, the blade shaft 54 has an upper end 56, by which it is attached to the gear train 52. The lower end of the blade shaft 54 has a hexagonally-shaped face 58, complementary to that of the hub 62 of the cutting blade 60. When assembled, only a cutting blade having a hub as shown in FIG. 7 will be mountable on the blade shaft 54.

Figure 9:
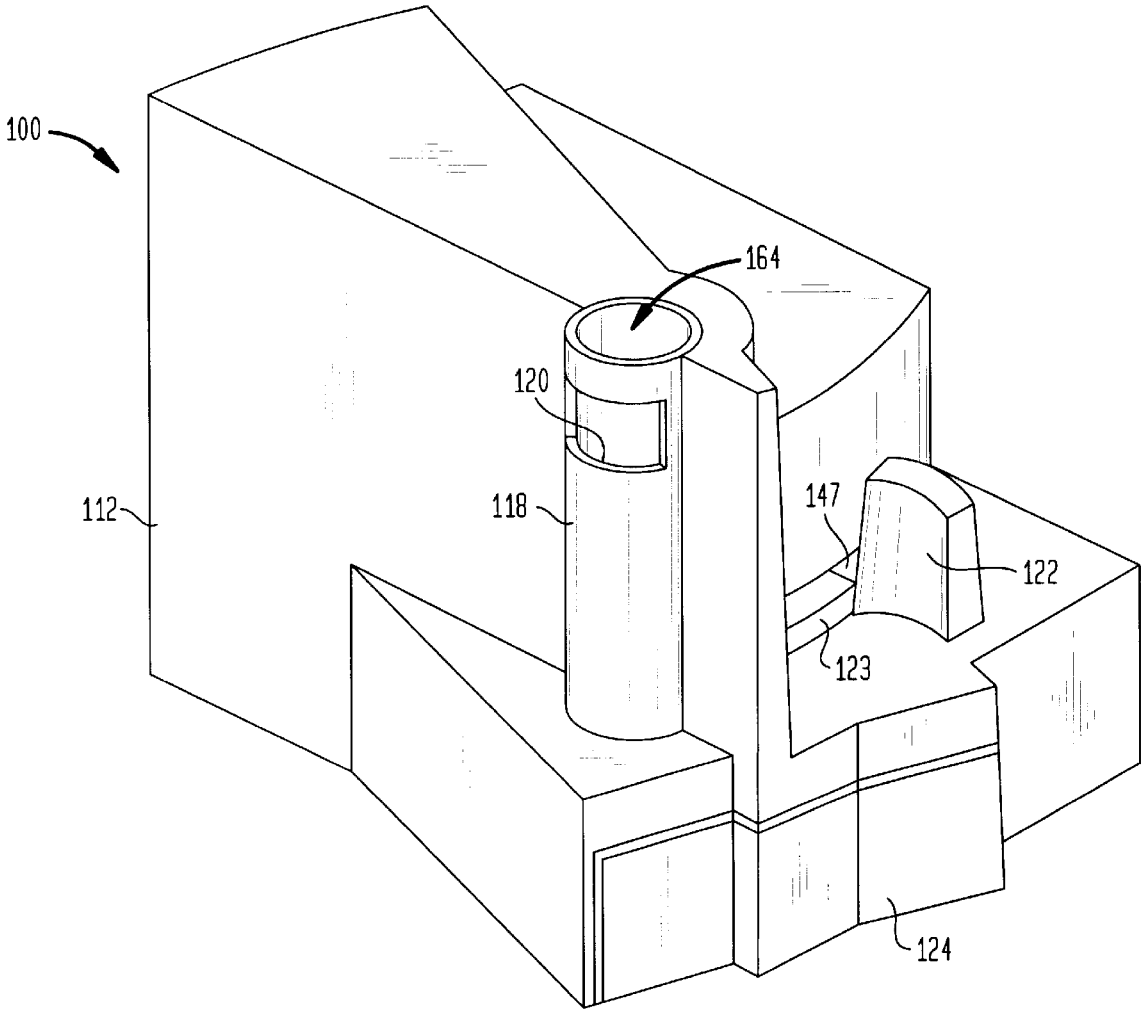
FIG. 9 is a front perspective view of an alternative embodiment of an electric cigar cutter constructed in accordance with the present invention.
Figure 10:
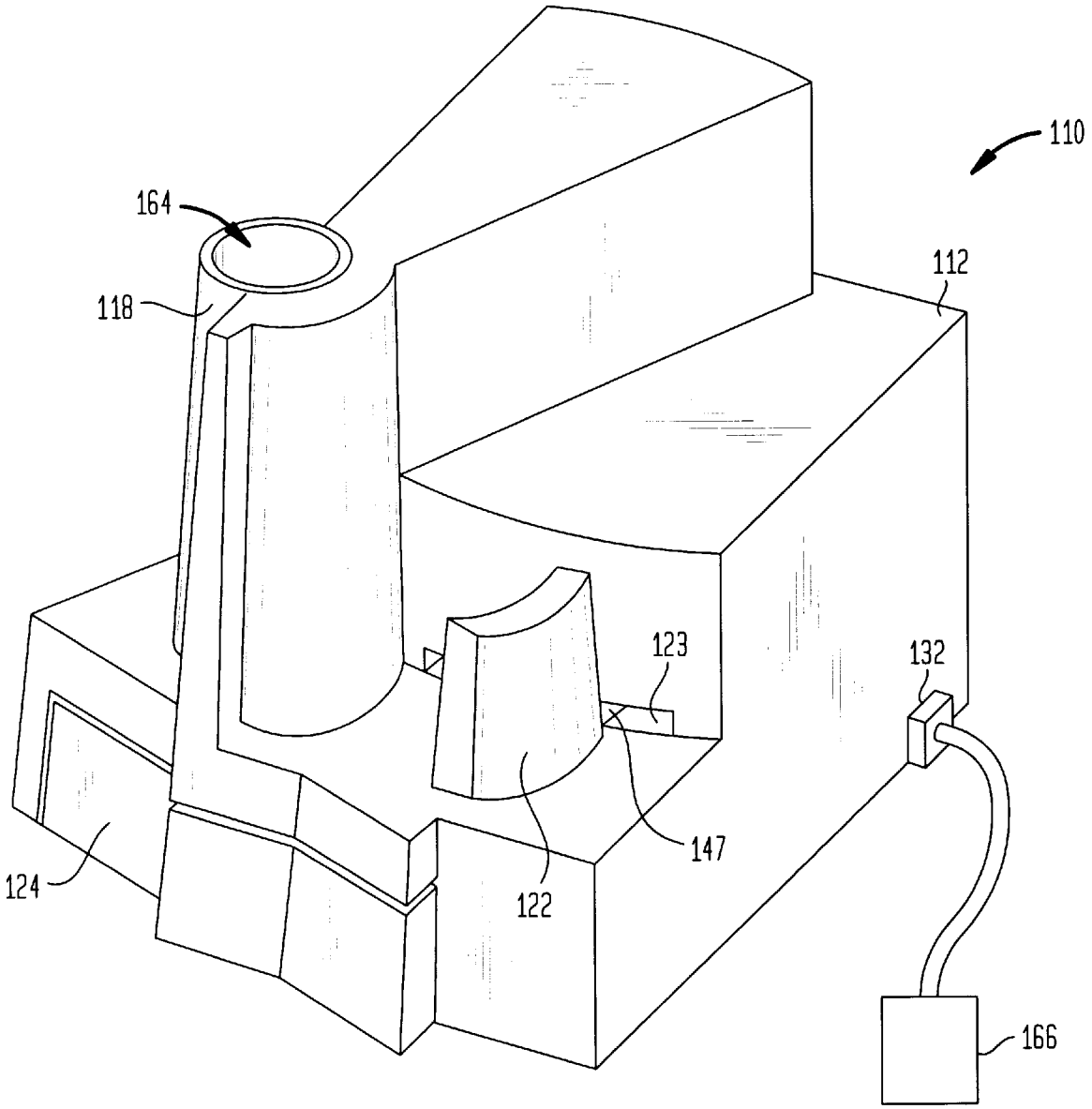
FIG. 10 is a rear perspective view of the cigar cutter shown in FIG. 9.

Another exemplary embodiment of an electric cigar cutter constructed in accordance with the present invention is illustrated in FIGS. 9 and 10. Elements illustrated in FIGS. 9 and 10 which correspond to the elements described above with respect to FIGS. 1–8B have been designated by corresponding reference numerals increased by one hundred. The embodiment of FIGS. 9 and 10 is designed for use in the same manner as the embodiment of FIGS. 1–8B unless otherwise stated.

Referring to FIGS. 9 and 10, an electric cigar cutter 110 has a housing 112. A finger guard 118, having a finger access 120, is permanently mounted on the housing 112. A cigar holding tube 164 is formed by the respective curvatures of the finger guard 118 and the housing 112. A lever 122 is slidably positioned on the housing 112 and is connected to a gear box post 147 that extends through a slot 123 in the housing 112. The lever 122 is located behind that portion of the housing 112 where the finger guard 118 is mounted. A removable trimmings drawer 124 is located on a side of the housing 112, near the lever 122. An A.C. power source 166 is connected to the cigar cutter 110 via a power connector 132.

The main difference between the embodiment shown in FIGS. 1–8B and the embodiment shown in FIGS. 9 and 10 is in the design of the housings 12, 112. While the parts (i.e., the finger guards 18, 118 and the trimmings drawers 24, 124) are located on different sides of the respective embodiments, the internal construction and operation of the cigar cutters 10, 110 are identical.

It will be understood that the embodiments described herein are merely exemplary and that a person skilled in the art may make many variations and modifications without departing from the spirit and scope of the present invention. For instance, the housing design could be varied for aesthetic reasons or to accommodate D.C. operation (i.e., a battery compartment), which would replace the need for the A.C. power source 66 and the power connector 32. It is also possible to make the entire cigar cutter 10 smaller, for example, in a pocket-sized version. Additionally, the shape of the face 58 of the blade shaft 54 and the shape of the hub 62 of the cutting blade 60 could be varied to accommodate different shapes, provided that the face 58 and the hub 62 are of a complementary design. All such variations and modifications are intended to be included within the scope of the invention as defined in the appended claims.

What is claimed is:

1. An electric cigar cutter, comprising:

a housing having an interior, an arcuate portion, and an arcuate finger guard;

holding means for holding a cigar to be cut at a cutting site located in said interior of said housing, said holding means including a tube having a side provided with an access opening for a user's finger, said tube being sized and shaped to hold a cigar and extending into said interior of said housing, said arcuate portion of said housing and said finger guard cooperating to delimit said tube;

a motor contained in said interior of said housing;

connecting means for connecting said motor to a rotatable cutting blade, said connecting means and said cutting blade being located in said interior of said housing;

pivoting means for pivoting said cutting blade between a first position, in which said cutting blade is positioned remote from said cutting site, and a second position, in which said cutting blade is positioned at said cutting site; and activating means for activating said motor.

2. An electric cigar cutter according to claim 1, wherein said tube includes an open first end external to said housing, said first end being sized and shaped to receive a cigar, and an open second end internal to said housing, said second end being positioned above said cutting site.

3. An electric cigar cutter according to claim 1, wherein said connecting means includes a gear train interposed between said motor and said cutting blade.

4. An electric cigar cutter according to claim 1, wherein said pivoting means includes a pivot located in said inter af said housing;

a gear box pivotally mounted on said pivot in said interior of said housing, said gear box being pivotable between a third position, in which said gear box resides when said cutting blade is in its said first position, and a fourth position, in which said gear box resides when said cutting blade is in its said second position;

a blade shaft attached to said gear box, said cutting blade being attached to said blade shaft;

a post connected to said gear box, said post extending through a slot in said housing; and a lever attached to said post, said lever being located externally of said housing.

5. An electric cigar cutter according to claim 4, wherein said pivoting means further includes a return spring mounted on said gear box, such that said return spring is compressed when said gear box is in its said fourth position, said return spring being capable of returning said gear box from its said fourth position to its said third position as said return spring expands.

6. An electric cigar cutter according to claim 4, wherein said lever is sized and shaped so as to be gripable by a user for manual movement thereof.

7. An electric cigar cutter according to claim 4, wherein said blade shaft has a face shaped as an equilateral triangle with blunt corners, and wherein said cutting blade has a central hub having a shape which corresponds to the shape of said face of said blade shaft.

8. An electric cigar cutter according to claim 1, wherein said activating means includes a first contact mounted on said pivoting means and a second contact positioned in said interior of said housing, said first contact engaging said second contact as said pivoting means pivots said cutting blade from its said first position toward its said second position, thereby completing an electric circuit to activate said motor.

9. An electric cigar cutter according to claim 8, further comprising safety means for preventing accidental activation of said motor.

10. An electric cigar cutter according to claim 9, further comprising a removable drawer located on a side of said housing, said drawer being positioned underneath said cutting site and being sized and shaped so as to receive cut-off cigar tips.

11. An electric cigar cutter according to claim 10, wherein said safety means includes a third contact mounted on said drawer and a fourth contact positioned in said interior of said housing, such that said third contact engages said fourth contact only when said drawer is inserted into said housing, thereby completing an electric circuit to permit activation of said motor.

12. An electric cigar cutter according to claim 1, further comprising adjustment means for adjusting the amount of a cigar to be cut off.

13. An electric cigar cutter according to claim 1, further comprising a removable trimmings drawer located on a side of said housing, said drawer being positioned underneath said cutting site and being sized and shaped so as to receive cut-off cigar tips.

14. An electric cigar cutter according to claim 1, wherein said tube has a length selected so as to prevent a user's finger from contacting said cutting blade.

15. An electric cigar cutter according to claim 14, wherein said length of said tube is at least 3.75 inches.

16. An electric cigar cutter, comprising:

a housing having an interior;

holding means for holding a cigar to be cut at a cutting site located in said interior of said housing;

a motor contained in said interior of said housing;

connecting means for connecting said motor to a rotatable cutting blade, said connecting means and said cutting blade being located in said interior of said housing;

pivoting means for pivoting said cutting blade between a first position, in which said cutting blade is positioned remote from said cutting site, and a second position, in which said cutting blade is positioned at said cutting site;

activating means for activating said motor; and adjustment means for adjusting the amount of a cigar to be cut off.

17. An electric cigar cutter according to claim 16, further comprising a removable drawer located on a side of said housing, said drawer being positioned underneath said cutting site and being sized and shaped so as to receive cut-off cigar tips.

18. An electric cigar cutter according to claim 17, wherein said adjustment means includes a stop mount located inside said drawer and an adjustable end stop threadedly positioned on said stop mount, said end stop being located underneath said cutting site.

19. An electric cigar cutter according to claim 19, wherein said holding means includes a tube sized and shaped to hold a cigar, said tube extending into said interior of said housing and having a length selected so as to prevent a user's finger from contacting said cutting blade.

20. An electric cigar cutter according to claim 19, wherein said length of said tube is at least 3.75 inches.

21. An electric cigar cutter, comprising:

a housing having a lower section and an upper section extending upwardly from said lower section;

a motor contained in said lower section of said housing;

a cutting blade rotatably mounted in said lower section of said housing;

connecting means for connecting said motor to said cutting blade;

holding means for holding a cigar to be cut at a cutting site located in said lower section of said housing, said holding means including an elongated tube sized and shaped to hold a cigar in a generally upright orientation, said tube extending between a first end thereof, which is external to said housing and remote from said lower section of said housing, and a second end thereof, which is internal to said housing and proximate to said lower section of said housing, said first end having a first opening sized and shaped so as to receive a cigar and said second end having a second opening sized and shaped so as to receive a tip of a cigar, said first and second ends of said tube being spaced apart such that said tube has a length, as measured between said first and second ends thereof, which inhibits a user's finger from contacting said cutting blade, at least a substantial portion of said length of said tube being coextensive with said upper section of said housing;

pivoting means for pivoting said cutting blade between a first position, in which said cutting blade is positioned remote from said cutting site, and a second position, in which said cutting blade is positioned at said cutting site; and activating means for activating said motor.

22. An electric cigar cutter according to claim 21, wherein said length of said tube is at least 3.75 inches.

* * * * *

UNITED STATES PATENT AND TRADEMARK OFFICE

CERTIFICATE OF CORRECTION

PATENT NO. : 6,023,845
DATED : February 15, 2000
INVENTOR(S) : Loyd C. Moore

It is certified that error appears in the above-identified patent and that said Letters Patent is hereby corrected as shown below:

Column 5,
Line 20, delete “inter” and insert -- “interior” --.
Line 21, delete “af” and insert -- “of” --; and Column 6,
Line 44, “claim 19” and insert -- “claim 16” --.

Signed and Sealed this

Twenty-eighth Day of October, 2003

JAMES E. ROGAN
*Director of the United States Patent and Trademark Office*